US006945872B2

(12) United States Patent
De Vogel

(10) Patent No.: US 6,945,872 B2
(45) Date of Patent: Sep. 20, 2005

(54) APPARATUS FOR GENERATING AN OPTICAL ILLUSION

(76) Inventor: Leonard De Vogel, Van Oldenbarneveldtstraat 21, 1052 JR Amsterdam (NL)

( * ) Notice: Subject to any disclaimer, the term of this patent is extended or adjusted under 35 U.S.C. 154(b) by 0 days.

(21) Appl. No.: 10/802,330

(22) Filed: Mar. 16, 2004

(65) Prior Publication Data

US 2005/0075176 A1 Apr. 7, 2005

Related U.S. Application Data

(63) Continuation of application No. PCT/NL02/00595, filed on Sep. 18, 2002.

(30) Foreign Application Priority Data

Sep. 19, 2001 (NL) ..... 1018989

(51) Int. Cl.[7] ..... A63J 5/00
(52) U.S. Cl. ..... 472/63; 40/414; 40/429
(58) Field of Search ..... 472/57, 61, 63, 472/71, 137; 40/414, 429, 456, 493; 446/219, 236, 330, 332

(56) References Cited

U.S. PATENT DOCUMENTS 631,306 A 8/1899 Hollingsworth
1,098,761 A * 6/1914 Rehlin ..... 40/426
1,523,154 A 1/1925 Yuskiewicz
2,066,239 A 12/1936 Tahsler
2,836,912 A * 6/1958 Ranucci ..... 40/470
3,122,859 A * 3/1964 La Reaux, Jr. ..... 446/152
4,738,038 A * 4/1988 Tanne et al. ..... 40/506
4,870,768 A * 10/1989 Watt et al. ..... 40/430
5,224,901 A * 7/1993 Dahl et al. ..... 472/63
5,297,352 A * 3/1994 Poll ..... 40/427
5,412,890 A * 5/1995 Fechter ..... 40/414
5,655,321 A * 8/1997 Chang ..... 40/409
5,842,296 A 12/1998 Liu
5,915,853 A * 6/1999 Guilin ..... 40/414
6,675,513 B2 * 1/2004 Liao ..... 40/426

FOREIGN PATENT DOCUMENTS

FR 2379828 9/1978

* cited by examiner

*Primary Examiner*—Kien Nguyen
(74) *Attorney, Agent, or Firm*—Peacock Myers P.C.; Jeffrey D. Myers

(57) ABSTRACT

An apparatus for generating an optical illusion comprising at least one mirror, and placed in front of the mirror a figure that is visible directly as well as via the mirror, the at least one mirror being rotatable about an axis of the apparatus, and while in use, the figure describing a path about the axis of the apparatus in such a way as to be continuously in front of the mirror, the figure during its progress over the path around the axis of the apparatus undergoing a rotation from its body axis as a rate of rotation that depends on its rate of progress over the path.

8 Claims, 2 Drawing Sheets

APPARATUS FOR GENERATING AN OPTICAL ILLUSION

Figure 1:
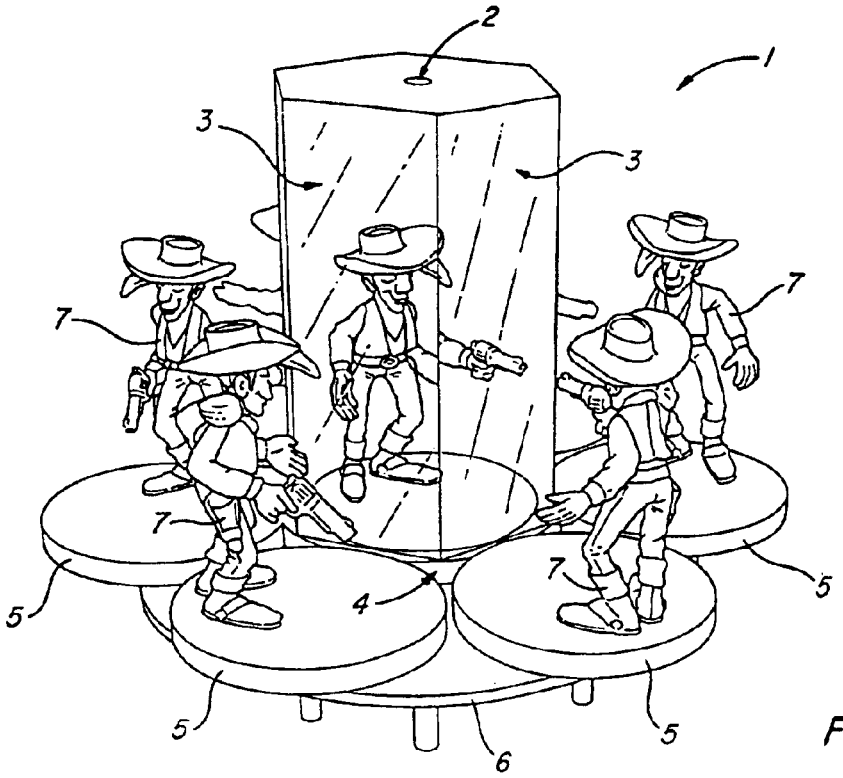

The invention relates to an apparatus for generating an optical illusion comprising at least one mirror, and placed in front of the mirror a figure that is visible directly as well as via the mirror, the at least one mirror being rotatable about an axis of the apparatus, and while in use, the figure describing a path about the axis of the apparatus in such a way as to be continuously in front of the mirror.

Such an apparatus has been proposed before and is marketed under the name of "the amazing praxinoscope kit".

The known apparatus comprises a fixed plate on which a number of figures are placed, each of which in front of a mirror surface. All the mirror surfaces together form a polyhedron arranged around an axis of symmetry of the apparatus. The figures placed in front of the mirror surfaces can be seen directly as well as via the mirrors. The apparatus is further rotatable in its entirety.

It is the object of the invention to provide an apparatus for generating an optical illusion with which very special effects can be attained that will be elucidated hereinafter.

The apparatus according to the invention is characterized, in that during its progress over the path around the axis of the apparatus, the figure undergoes a rotation about its body axis at a rate of rotation that depends on its rate of progress over the path. This results in the surprising effect that the mirror image of the figure may be stationary, while the respective figure carries out a combined movement composed of the progress in its path and the rotation about its body axis. Incidentally, by suitably choosing the rate of rotation of the figure it is also possible not to have the mirror image of the figure stand still, but to also let it carry out a rotational movement that may be greater or smaller than the rotational movement of the actual figure.

The aforesaid surprising effect of the apparatus according to the invention may be especially conveniently realised in the embodiment characterized in that the figure is mounted on a rotatable carrier, which together with the at least one mirror is position-invariantly placed on or in a frame that is rotatable about the axis of the apparatus. Incidentally, it is also possible for the carrier and the figure to form one whole. In order to achieve the desired effect, it is further desirable for the rotatable carrier to be provided with a drive organ that is coupled with the axis of the apparatus, such that the drive organ is dependent on the carrier's rate of progress over the path.

There are various ways for driving the rotatable carrier on which the figure is mounted.

In a first preferred embodiment of the apparatus, driving is realised by placing the axis of the apparatus centrally and equipping it with a stationary sun wheel, and by coupling the rotatable carrier with a rotatable planet wheel that is able to move around the sun wheel and interacts with the sun wheel to determine the planet wheel's rate of rotation.

For a position-fixed coupling of the rotation imposed on the figure subject to the position assumed by said figure in its path about the axis of the apparatus, it is desirable for the sun wheel and the planet wheel to be provided with interacting toothing.

As already mentioned above, it is possible to vary the rate of the figure's rotation without disrupting the relation with its rate of progress around the axis of the apparatus. However, in a certain aspect of the invention, the apparatus is characterized in that the sun wheel and the planet wheel have the same diameter. This results in the earlier mentioned surprising effect of the mirror image of the figure being stationary while the figure carries out the said combined movement of progressing over the path and the rotational movement.

As already mentioned, there are various possibilities of realising the drive for the rotational movement of the figure. A second preferred embodiment of the apparatus in which such a drive is provided is characterized in that the drive organ is formed as a drive belt that is coupled with the rotatable carrier and with the axis of the apparatus.

The apparatus is further preferably realised such that there are two or more mirrors, each mirror forming a surface of a closed polyhedron, and that in front of each mirror of the polyhedron a figure is placed, each figure undergoing a rotation about the body axis at a speed of rotation that depends on the figure's rate of progress about the axis of the apparatus. In this way it is possible that the mirror images of said figures when looked at from a fixed point of observation, appear to be in one place, whereas the figures are progressing over their path. When giving the figures successively each time a slightly different pose or form, the mirror image seen from the said point of observation will appear to go through a flowing movement or change.

Hereinafter the invention will be elucidated with reference to a non-limiting exemplary embodiment of an apparatus constructed in accordance with the invention, and with reference to the drawing.

Figure 2:
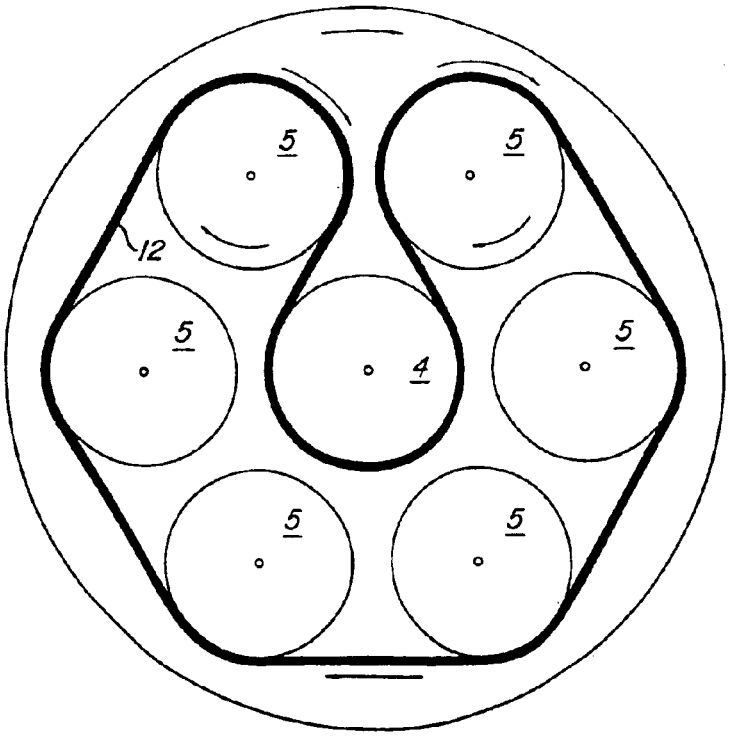
Figure 3:
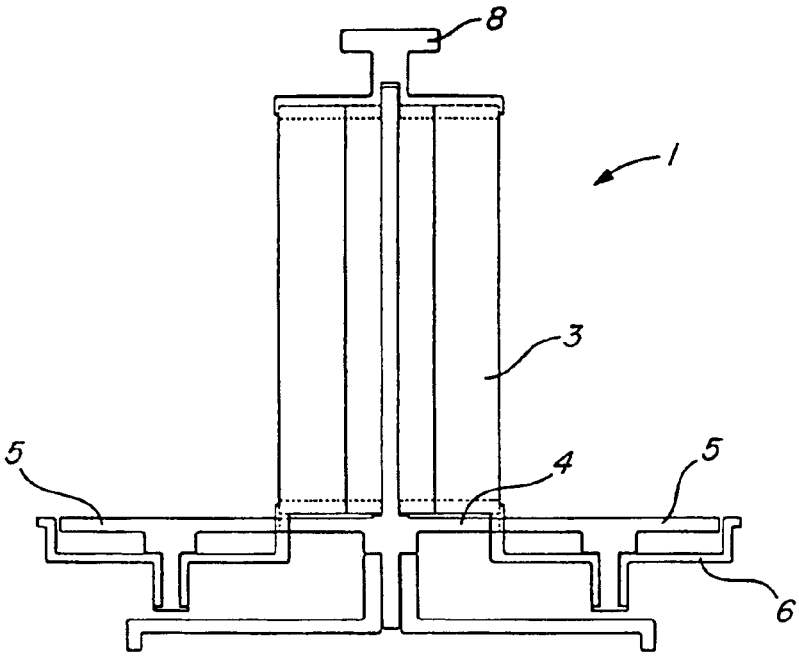
Figure 4:
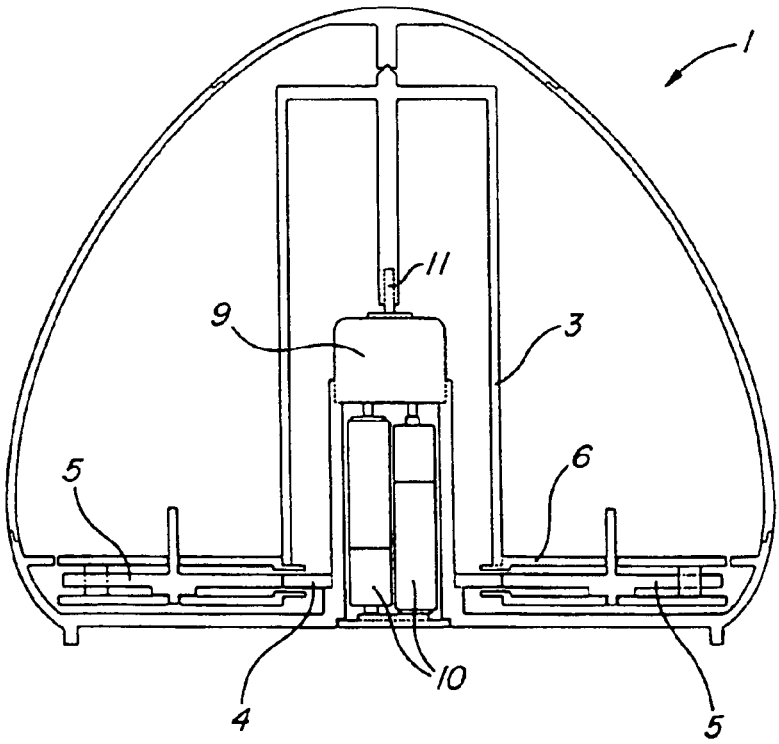

The drawing shows:

in FIG. 1 the apparatus according to the invention in a first embodiment, omitting a number of inconsequential parts;

in FIG. 2 a schematic bottom view of the drive of an apparatus according to the invention in a second embodiment;

in FIG. 3 a cross section of the apparatus according to the invention embodied with a planet and gear wheel system with the omission of a number of parts; and in FIG. 4 a third embodiment of the apparatus according to the invention with a mechanised drive.

Identical reference numbers used in the figures refer to similar parts.

Referring first to FIG. 1, the apparatus according to the invention for the generation of an optical illusion is shown, generally indicated by reference number 1. The apparatus 1 has a central axis of apparatus 2, in relation to which a plurality of reflecting surfaces 3 are placed to form a symmetrical polyhedron.

In a first embodiment, a stationary sun wheel 4 is placed at the foot of the mirror surfaces 3. Coupled to this sun wheel 4 are a plurality of planet wheels 5 that are mounted on a frame 6. The mirror surfaces 3 are also mounted on this frame 6 in such a manner that each planet wheel 5 is continuously in the same position in front of the respective mirror surface 3. Rotation of the frame 6 causes the planet wheels 5 to move slowly along the stationary sun wheel 4, causing them to rotate around their planet axis. On each planet wheel 5 a figure is mounted; in the case illustrated this is "Lucky Luke", the man who shoots faster than his shadow. The construction shown also causes the figures 7 to rotate during the progress of the planet wheels 5 in their path around the sun wheel 4.

In the case shown in FIG. 1, the planet wheels 5 are embodied with a diameter identical to that of the sun wheel 4. The result is that the progress of the planet wheels 5 over their path causes the figures 7 to move in such a manner that the mirror image observed in a mirror surface 3 is stationary.

FIG. 2 shows an alternative embodiment for the coupling between the sun wheel 4 and the planet wheels 5. In the construction shown in FIG. 2, said coupling is provided by a drive belt 12; incidentally, other couplings such as chain drives, string drives and hydraulic or electric motor drives are also possible. One thing and another also depends on the dimensions of the apparatus, which may vary from a few centimetres to several metres.

FIG. 3 shows an example of a manually operated apparatus according to the invention, in which the frame 6 and the mirror surfaces 3 can be made to rotate by means of a control button 8 positioned at the top of the apparatus.

FIG. 4 shows such an apparatus driven by an electromotor 9, fed by batteries 10. The frame 6 of the apparatus 1 is coupled via the mirror surfaces 3 with the driven shaft 11 of the electromotor 9.

To the person skilled in the art it is clear that within the frame of the invention several other variations are conceivable. The foregoing explanation of the invention referring to a number of exemplary embodiments must therefore not be understood to be limiting in any way. Said explanation merely serves to alleviate any possible ambiguities in the appended claims, which determine the protective scope of the invention.

What is claimed is:

1. An apparatus for generating an optical illusion comprising at least one mirror, and placed in front of the mirror a figure that is visible directly as well as via the mirror, the at least one mirror being rotatable about an axis of the apparatus, and while in use, the figure describing a path about the axis of the apparatus in such a way as to be continuously in front of the mirror, wherein during its progress over the path around the axis of the apparatus, the figure undergoes a rotation about its body axis at a rate of rotation that depends on its rate of progress over the path.

2. An apparatus according to claim 1, wherein the figure is mounted on a rotatable carrier, which together with the at least one mirror is position-invariantly placed on or in a frame that is rotatable about the axis of the apparatus.

3. An apparatus according to claim 2, wherein the rotatable carrier is provided with a drive organ that is coupled with the axis of the apparatus, such that the drive organ is dependent on the carrier's rate of progress over the path.

4. An apparatus according to claim 3, wherein the drive organ is formed as a drive belt that is coupled with the rotatable carrier and with the axis of the apparatus.

5. An apparatus according to claim 1, wherein the axis of the apparatus is placed centrally and equipped with a stationary sun wheel, and the rotatable carrier is coupled with a rotatable planet wheel that is able to move around the sun wheel and interacts with the sun wheel to determine the planet wheel's rate of rotation.

6. An apparatus according to claim 5, wherein the sun wheel and the planet wheel are provided with interacting toothing.

7. An apparatus according to claim 5, wherein the sun wheel and the planet wheel have a same diameter.

8. An apparatus according to claim 1, wherein there are two or more mirrors, each mirror forming a surface of a closed polyhedron, and in front of each mirror of the polyhedron a figure is placed, each figure undergoing a rotation about the body axis at a speed of rotation that depends on the figure's rate of progress about the axis of the apparatus.

* * * * *